US008156869B2

(12) United States Patent
Dahlberg

(10) Patent No.: US 8,156,869 B2
(45) Date of Patent: Apr. 17, 2012

(54) METHOD OF PRODUCING PROPELLANT CHARGES FOR HIGH-VELOCITY PROJECTILES, PROPELLANT CHARGES PRODUCED ACCORDING TO THE METHOD, AND STICK PROPELLANT INTENDED FOR THE METHOD

(75) Inventor: Johan Dahlberg, Orebro (SE)

(73) Assignee: Eurenco Bofors AB, Karlskoga (SE)

( * ) Notice: Subject to any disclaimer, the term of this patent is extended or adjusted under 35 U.S.C. 154(b) by 600 days.

(21) Appl. No.: 12/297,744

(22) PCT Filed: Apr. 11, 2007

(86) PCT No.: PCT/SE2007/000336

§ 371 (c)(1),
(2), (4) Date: Feb. 2, 2009

(87) PCT Pub. No.: WO2007/123455

PCT Pub. Date: Nov. 1, 2007

(65) Prior Publication Data

US 2009/0139423 A1 Jun. 4, 2009

(30) Foreign Application Priority Data

Apr. 20, 2006 (SE) ..... 0600869

(51) Int. Cl.
*F42B 10/00* (2006.01)

(52) U.S. Cl. ..... 102/439; 102/288; 102/289; 102/292

(58) Field of Classification Search ..... 102/288, 102/289, 292, 439, 443, 478
See application file for complete search history.

(56) References Cited

U.S. PATENT DOCUMENTS

| | | | | |
|---|---|---|---|---|
| 5,712,445 | A * | 1/1998 | Kassuelke et al. | 102/288 |
| 5,821,449 | A * | 10/1998 | Langsjoen et al. | 102/288 |
| 5,892,172 | A * | 4/1999 | Candland et al. | 102/288 |
| 6,167,810 | B1 * | 1/2001 | Isle et al. | 102/443 |
| 6,209,460 | B1 | 4/2001 | Isle et al. | |
| 2004/0216823 | A1 * | 11/2004 | Dahlberg et al. | 149/109.6 |

FOREIGN PATENT DOCUMENTS

| | | |
|---|---|---|
| RU | 2100755 C1 | 12/1997 |
| RU | 2211436 C2 | 8/2003 |
| SE | 526316 | 8/2005 |

* cited by examiner

*Primary Examiner* — Gabriel Klein
(74) *Attorney, Agent, or Firm* — Connolly Bove Lodge & Hutz LLP

(57) ABSTRACT

The present invention relates to a method of producing propellant charges (2) of multi-perforated stick propellant with maximized charge weights for sub-calibre, armour-piercing, high-velocity projectiles (3), which are provided, for example, with six to eight, fixed stabilizing fins (5-10). The invention also encompasses a multi-perforated stick propellant (11-12) intended for this purpose and a propellant charge produced from multi-perforated stick propellant according to the methods.

19 Claims, 1 Drawing Sheet

METHOD OF PRODUCING PROPELLANT CHARGES FOR HIGH-VELOCITY PROJECTILES, PROPELLANT CHARGES PRODUCED ACCORDING TO THE METHOD, AND STICK PROPELLANT INTENDED FOR THE METHOD

This application is a National Stage of PCT/SE2007/000336 filed Apr. 11, 2007 which in turn claims priority from Swedish Application 0600869-2 filed Apr. 20, 2006, the entire contents of which are incorporated herein by reference.

TECHNICAL FIELD

The present invention relates to a method, in cartridged, sub-calibre, flechette projectile ammunition, of the type in which the constituent flechette projectiles, in their rear part, have multiple, preferably six to eight, fixed stabilizing fins protruding into a cartridge case forming part of a complete round, of enabling said cartridge case to be charged with the largest possible quantity of sticks of multi-perforated propellant arranged in the longitudinal direction of the cartridge case.

The invention also relates to a stick propellant multi-perforated transversely to its longitudinal direction and intended for the method, for producing propellant charges for sub-calibre, fin-stabilized, flechette projectiles having multiple, preferably six to eight, fixed stabilizing fins.

The invention further relates to a propellant charge of multi-perforated stick propellant produced according to any of the methods.

BACKGROUND OF THE INVENTION AND PRIOR ART

Sub-calibre, fin-stabilized, high-velocity projectiles are primarily used in tank guns for countering hostile tanks and their armour penetration capability depends on the velocity of the projectile when it strikes the target. Since the velocity of the projectile at the target in turn varies as a function of its muzzle velocity as it leaves the barrel from which it was fired, the highest possible muzzle velocity must be imparted to the projectile as it leaves the barrel.

This in turn requires propellant charges having a very high energy content, which at the same time, however, must have characteristics such that they are burned in the barrel during the passage of the projectile through the barrel without in the process giving rise to a barrel pressure that exceeds the maximum admissible values for the barrel.

The factor limiting the quantities of propellant and hence indirectly also the amounts of energy that can be used to accelerate the projectile in an existing barrelled weapon is usually the volume of the charge space available for the propellant charge in the barrel. Older tank guns have their respective charge spaces adapted to the propellant geometries that were available when the guns were designed, and the optimum quantity of propellant from a ballistic standpoint was then often incorporated into the design. Feasible ways of increasing the performance of these older guns might concentrate on the use of a more high-energy propellant, thereby increasing the energy content in the available charge space, which has already been done, or on increasing the density of the propellant charge, that is to say its energy content per unit volume, or both of these. The latter approach, however, must not be done in such a way that the combustion of the propellant charge is disrupted to the extent that it is no longer optimal from a purely ballistic standpoint. A propellant charge must not be more compact than the progressivity of the propellant will allow.

Until quite recently propellant charges for large-Calibre barrelled weapons such as tank guns and other artillery guns have generally consisted of freely disposed propellant grains of limited size, which may have been formed as granulated stick propellant with one or more longitudinal ignition or combustion channels, although it has also been possible to encounter propellant charges comprising a very large number of longer propellant sticks, each provided with a large number of transverse perforations, which when fired along their internal combustion channels are split up at the perforations by the gas pressure inside the combustion channels into shorter pieces, which are then burned in a manner similar to that of the granulated tubular propellant. Both of these propellant charge types, however, contain large volumes of empty space between the propellant grains or the propellant sticks.

In recent years, however, a start has been made on at least the experimental phase of updating an older idea for producing so-called multi-perforated propellant. This type of propellant is composed of propellant in block, stick or sheet form, provided with a very large number of parallel perforation channels, the internal spacing of which is intended to equal twice the distance that a propellant of the relevant chemical composition will burn during the dynamic pressure sequence in the barrelled weapon for which the propellant charge in question is intended during the period of time that a projectile launched by the propellant charge will spend in the barrel after the propellant charge has been ignited. Persons skilled in the art refer to said distance between two such combustion channels as the e-measurement of the propellant. The intention of the multi-perforated propellant is therefore that it should be ignited in all perforations and that the e-measurement should be selected so that as far as possible all the propellant will be burned before the projectile reaches the muzzle of the barrel.

The multi-perforated propellant charges are not all that easy to produce, since the e-measurement for propellants of a modern chemical composition will be from 0.5 mm up to almost 4 mm, whilst the perforation channels ought preferably to have a diameter of 0.3 to 1 mm.

As a theoretical idea, multi-perforated stick propellant is therefore by no means a novelty, even though the product in question has only recently become available to limited extent on the market. Examples of some older patents that describe the basic principles behind the multi-perforated propellant, without giving any more precise information on suitable perforation diameters and perforation intervals include U.S. Pat. No. 677,527 and GB 16,861 dating from 1895. Even in the 1890's therefore, some far-sighted engineers reasoning quite theoretically seem to have realized the advantages of the multi-perforated propellant. On the other hand we have not succeeded in finding any evidence of this having been put into practical application.

A suitable method and device for producing multi-perforated stick propellant is described in our own Swedish patent SE-518 867 (the equivalent of which is WO-02/083602). A general property of the multi-perforated propellant is that it burns progressively and hence it is possible to produce propellant charges that are very compact and thereby assume high charge weights and large energy contents per unit volume.

The sub-calibre, armour-piercing, high-velocity projectiles generally have a slender arrow shape and they are thereby relatively long, so that in cartridge form quite a large proportion of their length will protrude into the cartridge case and will thereby limit the space in the case which would otherwise have been available for propellant. Furthermore, because they are fired without any inherent spin, for control on their trajectory they are dependent upon fixed, rear-mounted stabilizing fins, which further limit and divide the space available in the cases into multiple smaller sections. Where the propellant charges consist of loose, finely granulated propellant the latter fact does not present any great problem, but as soon as one wishes to use multi-perforated stick propellant or other propellant that occurs in larger pieces, the division of the available space may present certain problems, especially when seeking to achieve extremely high charge weights where propellant charges containing unutilized vacant spaces here and there are consequently unacceptable.

In purely general terms, the availability of the multi-perforated propellant affords a fresh opportunity for producing propellant charges with extremely high charge weights, but it is then a matter of utilizing all available space for the propellant, unconstrained by the fact that it occurs in larger units such as stick, sheet or tubular form.

OBJECT AND CHARACTERISTICS OF THE INVENTION

An important object of the present invention is to provide a method for charging a cartridge case with the largest possible quantity of sticks of multi-perforated propellant arranged in the longitudinal direction of the cartridge case, said method substantially reducing and preferably eliminating the aforementioned problems.

Another object of the present invention is to provide an improved multi-perforated stick propellant for producing propellant charges for sub-calibre, fin-stabilized flechette projectiles, said stick propellant substantially reducing and preferably eliminating the aforementioned problems.

A further object of the present invention is to produce a propellant charge according to the method, said propellant charge substantially reducing and preferably eliminating the aforementioned problems.

Said objects and other aims not enumerated here are satisfactorily achieved through the specifications in the independent patent claims. Embodiments of the invention are specified in the dependent patent claims.

The present invention therefore relates to a method of producing propellant charges of multi-perforated propellant with maximum charge weights in such sub-calibre, flechette projectiles which have multiple, preferably six to eight fixed stabilizing fins depending on what space is available for this purpose. One sphere of application for the flechette projectile here described is in antitank ammunition, such as antitank flechette projectiles.

The method according to the invention is characterized in that for at least the part of the propellant charge intended for inclusion in that part of the cartridge case of the round in which the stabilizing fins of the flechette projectile will be situated, a multi-perforated stick propellant is chosen, which is perforated transversely to its longitudinal direction and has an equilateral trapezoidal cross section, which is adapted to the space between the stabilizing fins, and the cross-sectional dimensions and angles of which are matched to one another so that two such propellant sticks with their broad parallel sides resting against one another form a composite double propellant stick having an equilateral hexagonal cross section.

According to further aspects of the method according to the invention:

- the propellant sticks of trapezoidal cross section in the actual propellant charge are both combined in pairs to form composite, double propellant sticks of equilateral hexagonal cross section, and used singly to fill remaining spaces between such composite double propellant sticks arranged side by side and between the stabilizing fins of the flechette projectile and the inside of the cartridge case.
- the propellant sticks of trapezoidal cross section are combined to form block units, which are fitted in between respective stabilizing fins of the flechette projectile.
- the outer surface of the block unit intended to face the inside of the cartridge case is matched to the curved inside of the cartridge case by machining.

The invention also encompasses multi-perforated stick propellant which is designed for implementing said method and which according to the invention is characterized in that each propellant stick has an equilateral trapezoidal cross section which means that two such propellant sticks with their broadest parallel sides against one another form a composite double propellant stick having an equilateral hexagonal cross section.

The propellant charge of multi-perforated stick propellant is further characterized in that it is produced by any one of the methods according to the invention.

ADVANTAGES AND EFFECTS OF THE INVENTION

According to the present invention, in producing propellant charges for flechette projectiles having multiple, preferably six to eight stabilizing fins, a propellant material is used which comprises propellant sticks multi-perforated transversely to their longitudinal direction, with cross-sectional dimensions matched to the space between the fins, an equilateral trapezoidal cross section and cross-sectional dimensions and angles between lateral edges of the cross section that are matched to one another so that two such propellant sticks with their broad parallel sides bearing tightly against one another form a composite, double propellant stick having an equilateral hexagonal cross section. The term equilateral trapezoidal cross section is here intended to signify that the shorter parallel side of the cross section and its two inclined sides are equal. As is well known, a trapezium has two parallel sides, one of which is shorter than the other and two sides, which may be of equal length, inclined in relation to these parallel sides. Each propellant stick according to the invention will therefore have a cross section corresponding to half of an equilateral hexagon.

As will be seen from FIG. 2, the propellant sticks of trapezoidal cross section described above can either be combined to form hexagonal sticks or used singly but combined with composite hexagonal sticks for optimum filling of the available space between the fins of the flechette and the inside of the cartridge case, as shown in the drawing.

The type of propellant stick forming part of the invention and necessary for realizing the invention can be produced in a number of different ways. An already multi-perforated propellant stick of rectangular cross section can thus be endowed with the required shape by planning or other machining. The propellant channels in a multi-perforated propellant have in fact proved not to be significantly affected by such machining, although the wastage can render the method somewhat less satisfactory from an economic standpoint.

Another way of producing the requisite multi-perforated propellant stick material may be to provide a ready formed propellant material with multiple perforations. One method is then to undertake the perforation from the broad side of the trapezoidal cross-section, so that the perforation channels can be made shorter out towards the edges, which may be advantageous since it is a fact that the longer perforation channels, the greater the risk of damaging these, for example bending or breaking them. Where necessary, an underlying support shaped according to the trapezoidal cross section of the propellant stick material may be used during the actual perforation. Another method is to begin the perforation from the more tapering side of the cross section, it being possible in this case to support the propellant stick material against a plane surface during the perforation.

The invention is therefore based on the use of these specifically formed multi-perforated propellant sticks, which can be combined to form composite double propellant sticks having an equilateral hexagonal cross section but which can also be used for filling in between such composite double propellant sticks and between the fins of the flechette projectile and the inside of the cartridge case.

Further advantages and effects will be apparent from a study and consideration of the following detailed description of the invention, including a number of advantageous embodiments, from the patent claims and from the drawings attached.

BRIEF DESCRIPTION OF THE DRAWING

The invention has been defined in more detail in the patent claims below and is illustrated in the drawings attached, in which

DETAILED DESCRIPTION OF EMBODIMENTS

Figure 1:
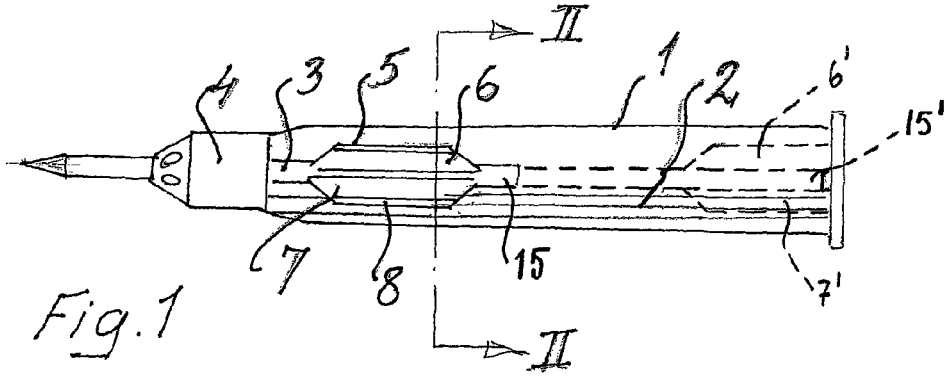
FIG. 1 shows a schematic longitudinal section through a cartridged, flechette projectile charge, also referred to below as a round.

The round with the flechette projectile charge shown in FIG. 1 comprises a cartridge case 1 and a sub-calibre, finned flechette projectile 3 cartridged in the cartridge case 1, together with an essentially quite vacant space in the propellant charge 2 of multi-perforated stick propellant 11 of the type characteristic of the invention that fills out the cartridge case 1. Also protruding approximately half-way into the cartridge case 1, in the example shown, is the rear part 15 of the finned, flechette projectile 3, where it therefore encroaches on the space that is available for the propellant charge 2. The remainder of the space in the cartridge case 1 could therefore contain another type of propellant charge. The location of the flechette projectile 3 in the cartridge case 1 is only shown schematically in FIG. 1. In an alternative, advantageous placing of the finned, flechette projectile 3, indicated by dashed lines, the rear end 15' of said flechette projectile 3 goes all the way down to the bottom of the cartridge case 1, where its stabilizing fins 5'-10' are arranged right at the back of the flechette projectile 3. In this case the entire charge space of the cartridge case 1 is filled with multi-perforated stick propellant 11 of the type characteristic of the invention.

In the exemplary embodiment shown the flechette projectile 3 has six stabilizing fins, bearing the reference numerals 5-10, whilst the reference numeral 4 relates to the sabots of the flechette projectile 3 that are discarded after launching. The number of stabilizing fins 5-10 may naturally vary according to need, the number of fins being four or eight etc., for example.

Figure 2:
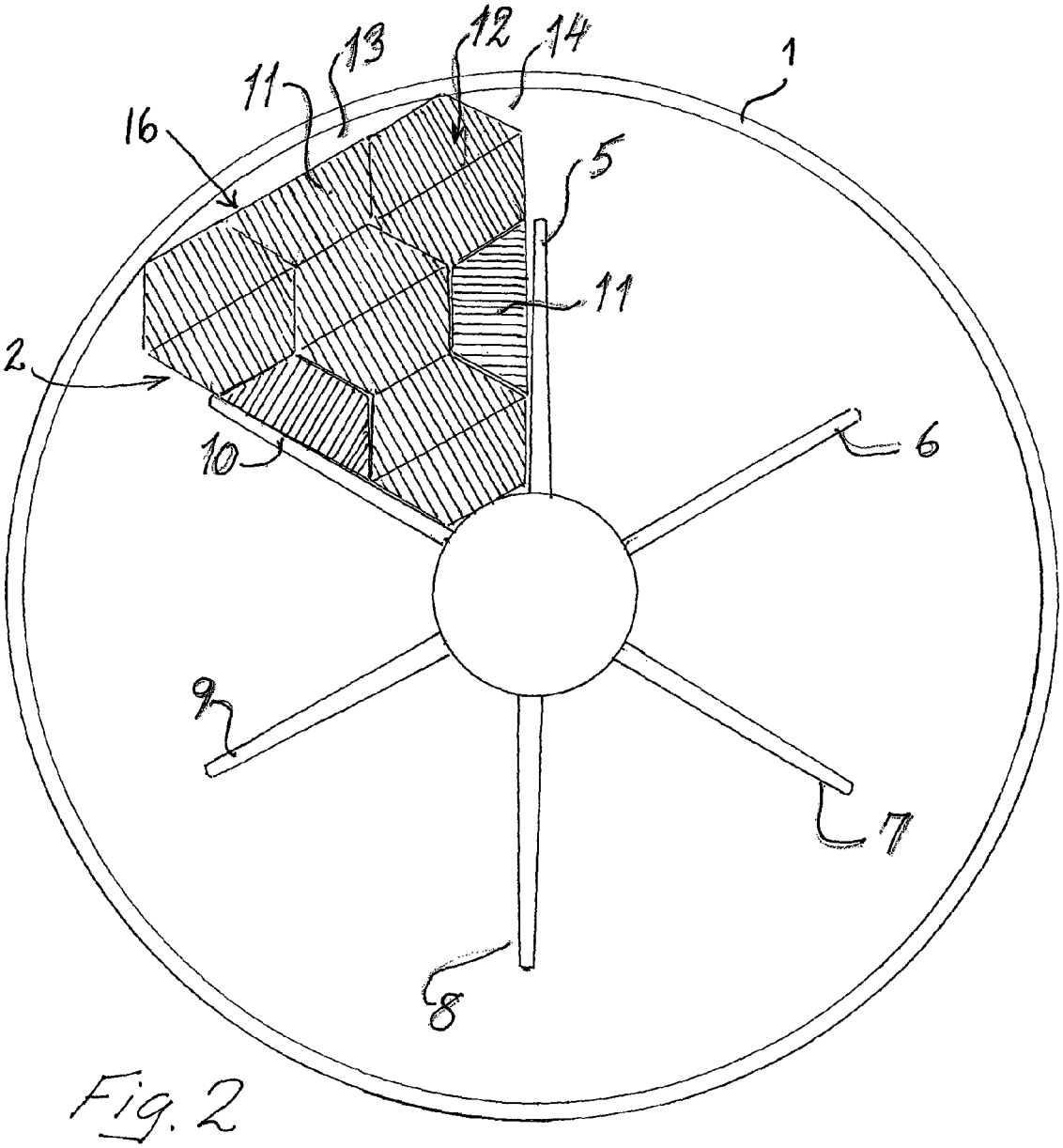
FIG. 2 schematically shows a section II-II through the flechette projectile charge according to FIG. 1, on a substantially large scale, in which for greater clarity the cross section of the propellant sticks used in the propellant charge have been drawn in only between two fins of the flechette projectile.

As can further be seen from FIG. 2, in the exemplary embodiment shown in the drawing four double propellant sticks 12 have been used, which together form a hexagonal cross section, together with three single propellant sticks 11, which have filled in the space between two adjacent stabilizing fins (in this case number 5 and 10). These single and double propellant sticks 11, 12 together form a block unit 16. Each double propellant stick 12 therefore comprises two combined single propellant sticks 11 of trapezoidal cross section. Other alternatives are obviously feasible, but the main difference is actually that the dimensions of the single propellant sticks 11 will vary and that the number of propellant sticks will differ, whilst the concept behind the solution remains unaltered. As long as the propellant sticks 11 used have the shape characteristic of the invention the charging principle remains the same.

As can be seen from the exemplary embodiment shown in FIG. 2, some minor gaps 13 and 14 occur nearest the inside of the cartridge case 1. These gaps 13 and 14, however, could be entirely eliminated if the propellant charge 2 were first formed around the fin set 5-10 of the flechette projectile 3 outside the cartridge case 1 and the various outermost propellant sticks 11, 12 in each such block unit 16 were there turned to the final shape, that is to say substantially the same external shape as the inside of the cartridge case 1, before introducing them into the cartridge case 1, since as already indicated multi-perforated propellant will withstand shaping by machining without this significantly affecting its function.

The invention claimed is:

1. Method, in cartridged, sub-calibre, flechette projectile ammunition, of the type in which the constituent flechette projectiles, in their rear part, have multiple fixed stabilizing fins protruding into a cartridge case forming part of a complete round, of enabling said cartridge case to be charged with the largest possible quantity of sticks of multi-perforated propellant arranged in the longitudinal direction of the cartridge case, characterized in that for at least the part of a propellant charge intended for inclusion in that part of the cartridge case of the round in which the stabilizing fins of the flechette projectile will be situated, a multi-perforated stick propellant is chosen, which is perforated transversely to its longitudinal direction and has an equilateral trapezoidal cross-section, which is adapted to the space between the stabilizing fins and the cross-sectional dimensions and angles of which are matched to one another so that two such propellant sticks with their broad parallel sides resting against one another form a composite double propellant stick having an equilateral hexagonal cross section.

2. Method according to claim 1, characterized in that the propellant sticks of trapezoidal cross section in the propellant charge are both combined in pairs to form composite, double propellant sticks of equilateral hexagonal cross section, and used singly to fill remaining spaces between such composite double propellant sticks arranged side by side and between the stabilizing fins of the flechette projectile and the inside of the cartridge case.

3. Method according to claim 1, characterized in that the propellant sticks of trapezoidal cross section are combined to form block units, which are fitted in between respective stabilizing fins of the flechette projectile.

4. Method according to claim 3, characterized in that the outer surface of the block unit intended to face the inside of the cartridge case is matched to the curved inside of the cartridge case by machining.

5. Method according to claim 2, characterized in that the propellant sticks of trapezoidal cross section are combined to form block units, which are fitted in between respective stabilizing fins of the flechette projectile.

6. Method according to claim 5, characterized in that the outer surface of the block unit intended to face the inside of the cartridge case is matched to the curved inside of the cartridge case by machining.

7. Method according to claim 1, wherein said projectiles have six to eight fixed stabilizing fins.

8. Method according to claim 2, wherein said projectiles have six to eight fixed stabilizing, fins.

9. Method according to claim 3, wherein said projectiles have six to eight fixed stabilizing fins.

10. Method according to claim 4, wherein said projectiles have six to eight fixed stabilizing fins.

11. Method according to claim 5, wherein said projectiles have six to eight fixed stabilizing fins.

12. Method according to claim 6, wherein said projectiles have six to eight fixed stabilizing fins.

13. Stick propellant multi-perforated transversely to its longitudinal direction and intended for producing propellant charges for sub-calibre, fin-stabilized, flechette projectiles having multiple fixed stabilizing fins by the method according to claim 1, characterized in that each propellant stick has an equilateral trapezoidal cross section, which means that two such propellant sticks with their broadest parallel sides laid against one another form a composite, double propellant stick having an equilateral hexagonal cross section.

14. Stick propellant according to claim 13, wherein said projectiles have six to eight fixed stabilizing fins.

15. Stick propellant multi-perforated transversely to its longitudinal direction and intended for producing propellant charges for sub-calibre, fin-stabilized, flechette projectiles having multiple fixed stabilizing fins by the method according to claim 2, characterized in that each propellant stick has an equilateral trapezoidal cross section, which means that two such propellant sticks with their broadest parallel sides laid against one another form a composite, double propellant stick having an equilateral hexagonal cross section.

16. Stick propellant multi-perforated transversely to its longitudinal direction and intended for producing propellant charges for sub-calibre, fin-stabilized, flechette projectiles having multiple fixed stabilizing fins by the method according to claim 3, characterized in that each propellant stick has an equilateral trapezoidal cross section, which means that two such propellant sticks with their broadest parallel sides laid against one another form a composite, double propellant stick having an equilateral hexagonal cross section.

17. Stick propellant multi-perforated transversely to its longitudinal direction and intended for producing propellant charges for sub-calibre, fin-stabilized, flechette projectiles having multiple fixed stabilizing fins by the method according to claim 4, characterized in that each propellant stick has an equilateral trapezoidal cross section, which means that two such propellant sticks with their broadest parallel sides laid against one another form a composite, double propellant stick having an equilateral hexagonal cross section.

18. Stick propellant multi-perforated transversely to its longitudinal direction and intended for producing propellant charges for sub-calibre, fin-stabilized, flechette projectiles having multiple fixed stabilizing fins by the method according to claim 6, characterized in that each propellant stick has an equilateral trapezoidal cross section, which means that two such propellant sticks with their broadest parallel sides laid against one another form a composite, double propellant stick having an equilateral hexagonal cross section.

19. Stick propellant multi-perforated transversely to its longitudinal direction and intended for producing propellant charges for sub-calibre, fin-stabilized, flechette projectiles having multiple fixed stabilizing fins by the method according to claim 5, characterized in that each propellant stick has an equilateral trapezoidal cross section, which means that two such propellant sticks with their broadest parallel sides laid against one another form a composite, double propellant stick having an equilateral hexagonal cross section.

* * * * *